US005218380A

United States Patent [19]

Fiscella

[11] Patent Number: 5,218,380

[45] Date of Patent: Jun. 8, 1993

[54] PLATEN DRAG MECHANISM FOR THERMAL PRINTERS

[75] Inventor: Marcello D. Fiscella, Fairport, N.Y.

[73] Assignee: Eastman Kodak Company, Rochester, N.Y.

[21] Appl. No.: 838,957

[22] Filed: Feb. 21, 1992

[51] Int. Cl.[5] ..... B61J 15/16

[52] U.S. Cl. ..... 346/136; 346/134; 346/76 PH; 400/617; 400/618; 400/636; 400/637; 400/639; 400/649; 400/120

[58] Field of Search ..... 346/76 PH, 134, 136; 400/120, 617, 618, 636, 637, 639, 649

[56] References Cited

U.S. PATENT DOCUMENTS

| | | | |
|---|---|---|---|
| 3,519,117 | 7/1970 | Smith . | |
| 3,746,142 | 7/1973 | Hepp et al. . | |
| 4,402,623 | 9/1983 | Biche et al. | 400/618 |
| 4,577,199 | 3/1986 | Saiki et al. | 346/76 PH |
| 4,642,569 | 2/1987 | Hayes et al. | 324/318 |
| 4,642,659 | 2/1987 | Nagashima et al. . | |
| 4,710,783 | 12/1987 | Caine et al. | 346/76 PH |
| 4,838,719 | 6/1989 | Kaisha | 400/618 |
| 4,972,207 | 11/1990 | Ishiyama et al. | 346/76 PH |
| 4,985,711 | 1/1991 | Nakamura et al. | 346/76 PH |

FOREIGN PATENT DOCUMENTS

| | | | |
|---|---|---|---|
| 0159084 | 8/1985 | Japan | 400/618 |
| 0191164 | 8/1987 | Japan | 400/618 |
| 0207663 | 9/1987 | Japan | 400/618 |
| 0211173 | 9/1987 | Japan | 400/618 |
| 0218165 | 9/1987 | Japan | 400/636 |

OTHER PUBLICATIONS

*Mark's Standard Handbook for Mechanical Engineers*, Eighth Edition, Mc-Graw Hill Book Company, copyright 1972, pp. 8-43, pp. 8-44, FIGS. 86 and 90.

*Primary Examiner*—Benjamin R. Fuller
*Assistant Examiner*—Huan Tran
*Attorney, Agent, or Firm*—Raymond L. Owens

[57] ABSTRACT

A continuous tone themal printing apparatus of the type having a printing station and a receiver paper drive station. The drive station repeatedly advances receiver paper back and forth through the printing station in conjunction with the advance of successive thermal transfer donor dye colors on a carrier web through the printing station to successively print the different color separations. The platen drum in the printing station is coupled to a platen drag force mechanism for imparting reverse torque to the torque imparted by the drive station to impart a degree of tension to the receiver paper as it passes through the printing station that exceeds stick/slip variations in movement of the receiver paper therethrough by the sublimation of the dyes from the donor dye carrier web to the receiver paper in the creation of the image thereon. The platen drag force may be effected by overdriving a motor or generator or drag brake coupled to the platen drum.

18 Claims, 3 Drawing Sheets

PLATEN DRAG MECHANISM FOR THERMAL PRINTERS

FIELD OF THE INVENTION

The present invention relates to thermal printers, and more particularly, to thermal printers that employ a capstan drive system to advance receiver paper through the printing station.

DESCRIPTION OF THE PRIOR ART

Commonly assigned U.S. Pat. No. 4,710,783 describes a thermal printer apparatus that uses a dye transfer process to form an image on a receiver paper using a multi-colored thermal transfer ribbon from which dye is transferred by heat generated by a thermal print head. The thermal print head is formed of, for example, a plurality of individual thermal heat producing elements, often referred to as heating elements. The receiver paper and the thermal transfer ribbon dye carrier are generally moved relative to the print head and a platen roller at the printing station. The receiver paper is repeatedly fed through the printing station between the print head and platen by the forward and reverse rotation of the platen and/or capstan and roller drive assemblies while the ribbon is advanced to present the three dye transfer colors, thus performing multi-color printing by the successive registration of the three color images as a single print image on the receiver paper.

As described more completely in the above-referenced '783 patent, incorporated herein by reference in its entirety, the print head is organized into a plurality of groups of heating elements that are capable of being energized for predetermined time periods that determine the gray scale of an image pixel transferred. Thermal dye transfer printer apparatus offer the advantage of true "continuous tone" dye density transfer. By varying the heat applied to each heating element to the carrier, a variable dye density image pixel is formed in the receiver. When a particular heating element is energized, it is heated and causes dye to transfer (e.g., by sublimation) from the carrier to the image pixel in the receiver paper image frame. The density, or darkness, of the printed dye is a function of the temperature of the heating element and the time the carrier is heated by that element. In other words, the heat delivered from the heating element to the carrier causes dye to transfer to an image pixel of a receiver. The amount of dye is directly related to the amount of heat transferred to the carrier.

As mentioned above, thermal printers successively overlay color dyes to form a full color image onto the receiver paper. Alignment of each successive color is crucial for good image quality. Capstan drive systems rely on a paper nip to drive the receiver paper past the print head and platen for each successive color. The capstan is intended to precisely drive the paper past the head in a synchronized manner with aligned printing of the linear array of the heating elements of the print head which are themselves individually actuated by digital image line data in storage buffers that are successively loaded for each line with digital data from memory registers of the microprocessor-based control system depicted, for example, in the above-incorporated '783 patent.

The misregistration of the individual lines of the successively transferred color images is more or less noticeable depending on the content of the image being printed. Slight misregistrations of the successive image pixels of a pictorial scene are usually acceptable. However, even slight misregistration of the successive image pixels of printed text may cause a halo effect of the misregistered colors at the borders of the characters. often it is desirable to print both pictorial scenes and alphanumeric characters as part of the same printed image, and misregistration may be only apparent in the printing of the characters.

Misregistration occurs from errors between the motion of the paper and the line placement of the head for each successively transferred color image. Since the receiver paper is a non-rigid structure i.e., like a rope), the paper must be maintained under near constant tension to ensure accurate motion. Paper under constant tension will maintain a predictable path through the head platen nip and this ensuring good synchronization between the paper motion and the line placement.

Various types of driving systems have been proposed to prevent misalignment of the color planes in either the front to back or side to side direction relative to the thermal print head. In the case of the standard capstan and pinch roller drive systems presently employed in certain thermal printing apparatus, shifts in the color planes occur due to uncontrolled back tension on the receiver paper. The uncontrolled back tension condition occurs because of the variability of the coefficient of friction at the head/receiver interface during printing. A stick/slip phenomena occurs at the head, due to the various levels of heat employed to create different density levels of the individual pixels. Therefore, the total tension on the receiver paper is comprised of the constant force from the capstan and the variable force of the head friction, and, as a result, the total paper tension varies from color pass to color pass, thus resulting in color misregistration.

Constant tension control can be achieved through an additional mechanism placed upstream from the print head as set forth in U.S. Pat. No. 4,642,569. The printer drive apparatus disclosed in the '569 patent employs a hard capstan roller and a softer pinch roller to form a driving nip to transport the receiver paper through the head and platen interface at the print station. The image forming method comprises multiple passes through the print station to transfer each color dye to the receiver. For example, a yellow, magenta, cyan and/or black dye pass for each printed image is made. In the '569 patent, the tension mechanism creates a back tension on the receiver greater than the force disturbance created during the printing process by virtue of the additional upstream capstan roller and pinch roller.

Other mechanisms for providing constant tension in the normal and reverse direction of the paper receiver through a print station in both thermal transfer printing and in other printing technologies are-disclosed in U.S. Pat. Nos. 4,402,623, 4,577,199, 4,838,719, 4,972,207, and 4,985,711. Typically, in these patents, the platen roller at the print station is driven along with upstream and/or downstream capstan rollers which may operate as a tension roller to apply tension to either discrete sheets of receiver paper moved through the printing station or the continuous web of receiver paper moved bidirectionally therethrough from a paper supply reel.

In either case, the prior art approach has been to add driven tensioning rollers in the paper travel path and to drive the tensioning rollers and platen at the same or slightly differing speeds through the use of a common motor drive and a timing belt or gear mechanism to impart constant tension to the paper. These types of systems inherently increase the size and complexity of the printer and require one more mechanical interface to touch the receiver paper which in turn can lead to scratching the printed image or the receiver paper.

SUMMARY OF THE INVENTION

The present invention solves the above-discussed problems of the prior art printers by providing a method and apparatus for tensioning the paper before the printing of the first color image and thereafter during each successive pass of the receiver paper through the printing station, thereby maintaining the paper under constant tension and avoiding any misregistration of the color separation images.

This is accomplished in the context of a thermal printer comprising a print station comprising a thermal print head comprising a plurality of heating elements and a platen drum mounted for forward and reverse rotation to present a receiving image paper to the thermal print head in a first, print direction of conveyance and to again present said receiving image paper to said thermal print head pursuant to the successive printing of different, overlying color separation images on the paper; driving means for driving the paper in the first print direction and a second, reverse direction comprising a capstan drive and a pinch roller adapted to bear against opposite surfaces of the paper and impart the direction of conveyance by rotating the capstan roller against the paper and pinch roller; means for advancing a dye carrier between the receiving paper and the print head heating elements to cause dye to transfer from the carrier to an image pixel in the receiver image by operation of the thermal printer heating elements; and means for applying a drag to the rotation of said platen drum in opposition to the rotation of said capstan in the print direction and to apply back tension on the receiver greater than the force disturbances created by the slipping and sticking phenomena occurring at the heating elements of the thermal printer.

The inventive platen drag applying means apparatus further comprises means for applying a rotational driving torque to said platen drum in opposition to the direction of the capstan drive and at a lower relative force to allow the capstan drive torque to override the rotational driving torque of the platen drum. The platen drag applying means may further comprise a drag brake attached to the freely rotating axle of the platen drum to inhibit its free rotation and impose a drag on the paper driven by the capstan roller. Alternatively, a low torque motor/generator may be employed that can be overdriven by the capstan torque.

BRIEF DESCRIPTION OF THE DRAWINGS

These and other features and advantages of the present invention will become more apparent by reference to the following detailed description thereof in conjunction with the drawings, wherein like parts are denoted by like reference numerals and wherein.

DESCRIPTION OF THE PREFERRED EMBODIMENTS

Figure 1:
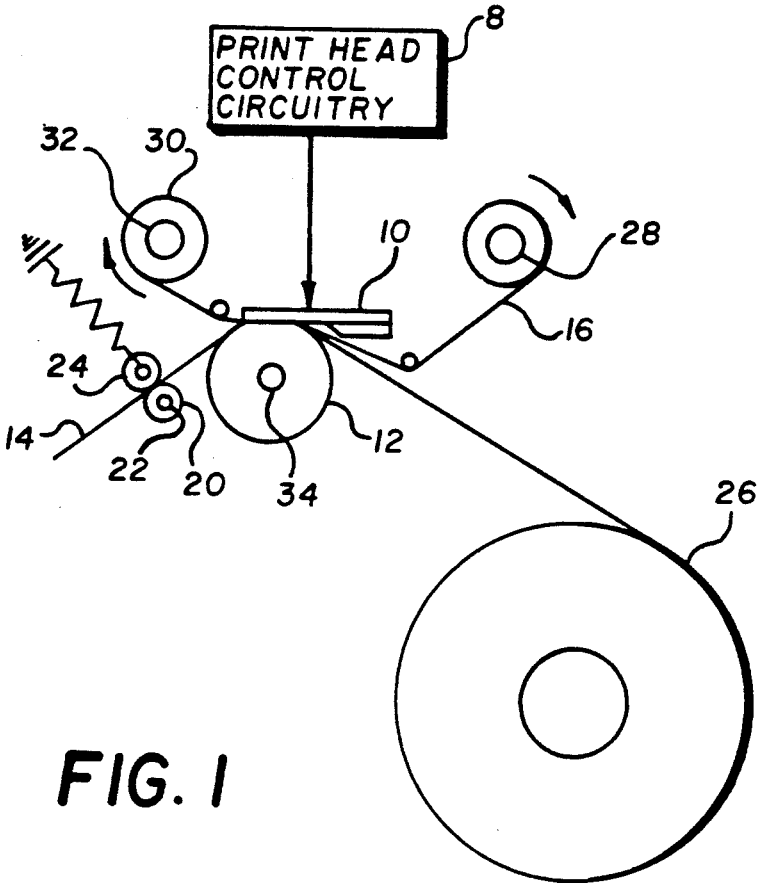
FIG. 1 is a schematic illustration of a thermal printer apparatus which can be employed to make continuous tone dye images in accordance with the invention.

Referring now to FIG. 1, a side view schematic illustration of a thermal printer apparatus which is adapted to print color images on a receiver member from dyes transferred thereto from a carrier member. The thermal print head 10 is depicted in relation to the platen drum 12 such that the receiver member 14 (a continuous web of paper in this illustration) and the donor dye carrier web 16 bear against one another, the platen drum 12 and the thermal print head 10 in a manner well known in the prior art and illustrated in the above-incorporated '783 patent FIG. 1. Unlike the '783 patent, however, the platen drum 12 in accordance with the present invention, is not itself driven by a drive mechanism to operate as the principal means of advancing a receiver member 14 bidirectionally through the the printing station.

The print head 10 includes a plurality of spaced-apart heating elements arranged in a line or set of lines transverse to the paper receiver member 14 and donor dye carrier web 16 in a fashion well known in the prior art. The individual heating elements press the carrier web 16 against the paper receiver member 14 and the platen drum 12 within the printing station. During printing, the heating elements are addressed and selectively energized as the carrier web 16 and the receiver member 14 are continuously advanced under the control of the print head control circuitry 18. Accordingly, the resultant dye image pixel will be somewhat larger than if the carrier and receiver were stationary during dye transfer. The movement of the carrier is necessary to reduce sticking of the carrier to the heating elements in the print head 10. Sticking, release and slippage may still be encountered depending on the heat intensity and resultant color density varies from element to element and color to color under the control of the print head control circuitry 18 and data supplied thereto to achieve the resultant tone and density at each individual pixel. It is this effect that can cause misregistration of the successive color images, apart from any misregistration caused by the failure of the drive system itself to operate consistently.

The drive system of the thermal printer apparatus as mentioned above, may involve driving the platen drum 12 as a capstan drive or drive roller in association with a separate capstan drive alone or in association with spaced-apart capstan drive and pinch roller assemblies. In FIG. 1, the drive mechanism for the receiver member 14 comprises the capstan 20 and its associated capstan drive 22 bearing against one surface of the receiver member 14, the other surface of which bears against a load-biased pinch roller 24 in order to advance the continuous web receiver member 14 through the printing station in a forward direction unwinding the receiver member 14 from the receiver supply roll 26 and in a reverse direction through the printing station in a fashion well known in the prior art.

Simultaneously, the donor dye carrier web 16 is advanced from a donor supply reel 28 to a donor take-up reel 30 by donor dye carrier web drive mechanism 32 also operating in a fashion well known in the prior art.

In accordance with the present invention, a platen drag force applying mechanism 34 is coupled to the platen drum 12 to apply a back tension to the receiver carrier 14 in the printing station in opposition to the capstan drive force imparted by the capstan roller 20, the capstan drive 22, and the pinch roller 24 in the driving station. The receiver tension can be defined as:

$$\text{Receiver tension} = \frac{\text{platen torque}}{\text{platen radius}}$$

Figure 2:
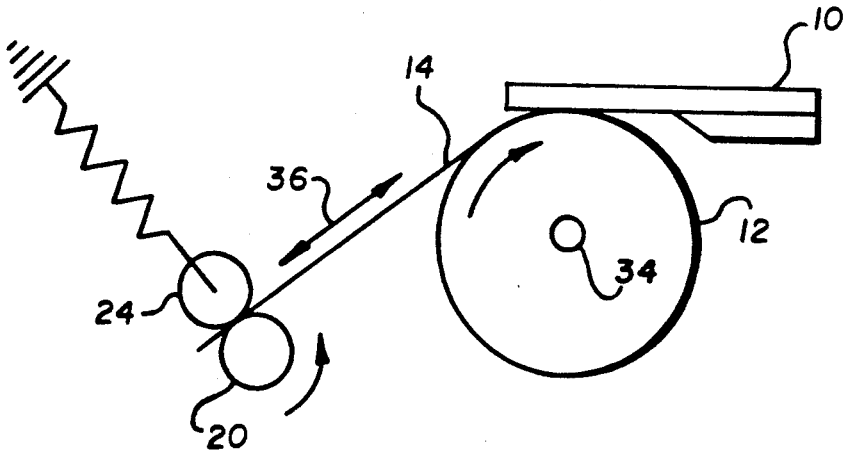
FIG. 2 is a partial illustration of the schematic illustration of FIG. 1 emphasizing the application of receiver paper tension in accordance with the invention.

Turning now to FIG. 2, the direction of application of the capstan drive torque and the platen drive torque is illustrated by the so-identified arrows. The receiver paper moves in the direction is denoted by the arrow 36 between the drive station comprising the capstan 20 and pinch roller 24 and the print station comprising the thermal print head 10, the platen drum 12, and the donor dye carrier web 16 (not illustrated). In accordance with the present invention, the platen drum 12 is coupled to the platen drag force mechanism 34 to impart a platen drag torque in a clockwise direction when the capstan drive torque is imparted in the counterclockwise direction. Advancement of paper receiver 14 through the printing station is achieved by ensuring that the capstan drive torque exceeds the platen drag torque, and the platen drag torque is preferably set to exceed the maximum stick force that the thermal print head 10 is capable of imparting on the receiver paper 14 in the printing station.

Figure 3:
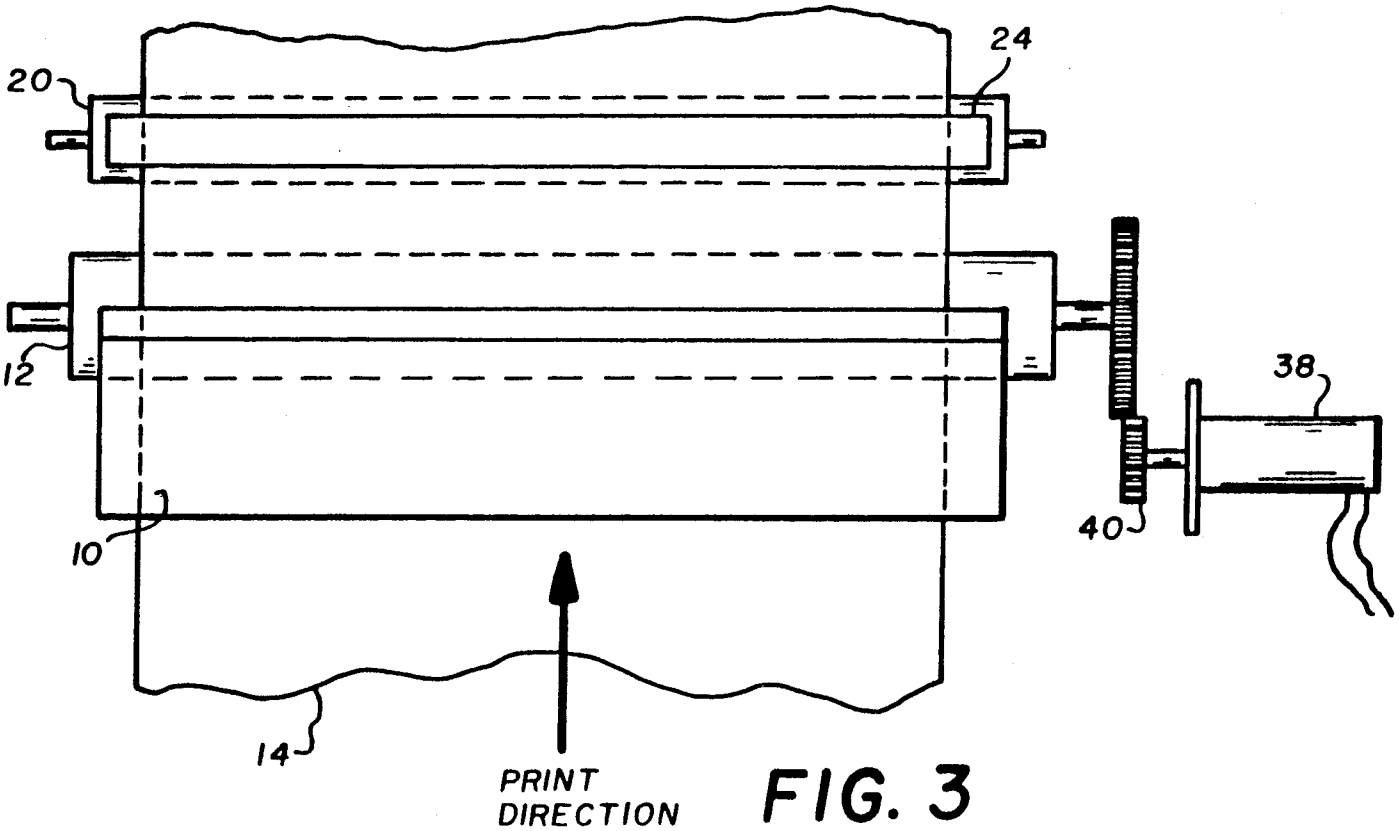
FIG. 3 is a top schematic illustration of the coupling of a platen drag force to the platen drum of FIGS. 1 and 2 to the use of a motor.
Figure 4:
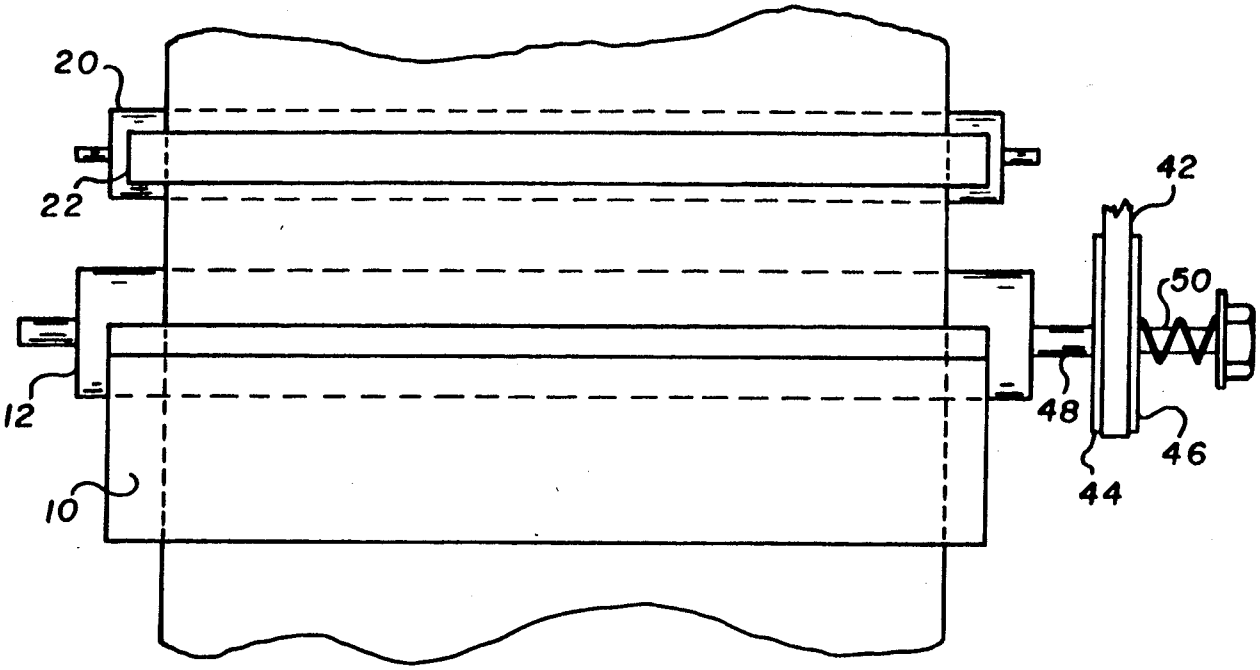
FIG. 4 is a top schematic illustration of the application of platen drag force to the platen drum through the use of a drag brake coupled axially thereto.

Several mechanisms can be envisaged for creating the platen drag torque, and two of those methods are illustrated in the embodiments of FIGS. 3 and 4. It should be noted that these mechanisms may be employed whether or not the receiver paper 14 is in the form of a roll or individual sheets of paper that are shuttled back and forth through the printing station between a supply tray, an intermediate holding tray and a completed print tray or collator, as is well known in the art.

Turning now to FIG. 3, it illustrates a top schematic view of a receiver paper sheet 14 in the printing station comprising the thermal print head 10 and the platen drum 12 and in the drive station comprising the capstan 20 and the pinch roller 24, together with the drag force mechanism 34. In the embodiment of FIG. 3, the drag force mechanism 34 comprises the DC motor 38, which is coupled through the transmission system 40 to the axle of the platen drum 12. The motor 38 is preferably a low speed, low torque motor which is selected such that the total torque developed through the transmission system 40 is less than the torque developed by the capstan 20 and pinch roller 24, therefore allowing the receiver paper 14 to move in the print direction and forcing the motor 38 to slip backwards.

Rather than powering the motor, it may be used as a generator having its armature windings coupled to a resistor load such that as the platen drum 12 is rotated by the forward direction movement of the paper 14, the current generated by the rotating armature can flow into the load resistor, thus loading down the motor/-generator 38 and creating the back torque on the platen drum 12. In this fashion, the motor/generator may be employed to impart the paper tension in the required direction opposite to the direction of printing of the receiver paper 14. Depending on the motor/generator selected and the torque that it develops, it may be possible to eliminate the transmission system 40 in favor of a direct coupling with the axle of the platen drum 12. It may also be possible to employ a reversing direction motor/transmission to provide the bidirectional back torque in bidirectional printer embodiments as described above.

FIG. 4 illustrates a further embodiment for imparting drag force to the platen drum 12 in either unidirectional or bidirectional printer embodiments where the drag force is effected by a mechanical, spring-loaded drag brake 42. The drag brake 42 may be constructed of a pair of facing disks 44 and 46, coupled respectively to the axle 48 and a springloaded, adjustable bolt 50, such that the opposing faces of the disks 44 and 46 frictionally engage one another and impede the free rotation of the platen drum 12 about its axis 48.

The drag brake 42 may alternately be constructed as an electrical brake in the well known fashion. Such well-known mechanical brake devices are described in *Mark's Standard Handbook for Mechanical Engineers*, Eighth Edition, McGraw-Hill Book Company, copyright 1972, at pp. 8–43, pp. 8–44, FIG. 86, for a mechanical disk brake, and FIG. 90 for an electrical eddy-current brake, incorporated in its entirety herein by reference.

The employment of the above-described platen drag force in the preferred embodiments for effecting that drag force advantageously reduces the misregistration caused by the stick/slip phenomena inexpensively and simply, involving few additional parts subject to breakdown or otherwise negatively affecting the printing system. It will be appreciated that the concepts of the present invention may be applied in other printing environments where it may be desirable to impart a back tension to the receiver medium to keep it straight in its path of travel through the printing station and to prevent creases from developing in it.

The invention having been described in detail with particular reference to certain preferred embodiments thereof will be understood to encompass variations and modifications thereof and equivalents thereto within the spirit and scope of the invention defined by the appended claims.

What is claimed is:

1. In a thermal transfer color printer, apparatus for avoiding misregistrations between successive color separation images on a sheet or web receiver upon which registered images are printed, comprising:

a print station comprising a thermal print head, having a plurality of heating elements and a platen drum mounted for forward rotation during presentation of the receiver to the thermal print head in a print direction of conveyance pursuant to successive printing of different, overlying color separation images on the receiver;

driving means for moving the receiver in the print direction;

means for advancing a dye carrier between the receiver and the print head heating elements to cause dye to transfer from the carrier to an image pixel in the receiver by operation of the thermal print head heating elements; and means for applying a drag to the rotation of said platen drum in opposition to the driving means to apply back tension on the receiver greater than force disturbances created by slipping and sticking phenomena occurring at the heating elements of the thermal print head.

2. The apparatus of claim 1 wherein said platen drag applying means apparatus further comprises means for applying a rotational driving torque to said platen drum in opposition to the print direction and at a lower relative force to allow the driving means to override the rotational driving torque and to cause the platen drum to slip backwards.

3. The apparatus of claim 1 wherein said platen drag applying means further comprises a drag brake attached to an axle of the platen drum to inhibit free rotation of the platen drum and impose a drag on the receiver driven by the driving means.

4. The apparatus of claim 1 wherein said platen drag applying means further comprises an electrical generator and a load, the generator coupled to the platen drum so a to generate electricity into the load upon rotation of the platen roller due to movement of the receiver through the print station by said driving means in the print direction.

5. In a thermal transfer color printer, apparatus for avoiding misregistrations between successive color separation images on a sheet or web receiver upon which registered images are printed, comprising:

a print station comprising a thermal print head, having a plurality of heating elements and a platen drum mounted for forward rotation during presentation of the receiver to the thermal print head in a first, print direction of conveyance pursuant to successive printing of different, overlying color separation images on the receiver;

driving means for moving the receiver in the first print direction comprising a capstan and a pinch roller adapted to bear against opposite surfaces of the receiver and impart the print direction of conveyance by rotating the capstan against the paper and pinch roller;

means for advancing a dye carrier between the receiver and the print head heating elements to cause dye to transfer from the carrier to an image pixel in the receiver by operation of the thermal print head heating elements; and means for applying a drag to the rotation of said platen drum in opposition to the rotation of said capstan in said first print direction of conveyance to apply back tension on the paper greater than force disturbances created by slipping and sticking phenomena occurring at the heating elements of the thermal print head.

6. The apparatus of claim 5 wherein said platen drag applying means apparatus further comprises means for applying a rotational driving torque to said platen drum in opposition to the first, print direction and at a lower relative force to allow the driving means to override the rotational driving torque and to cause the platen drum to slip backwards.

7. The apparatus of claim 5 wherein said platen drag applying means further comprises a drag brake attached to an axle of the platen drum to inhibit free rotation of the platen drum and impose a drag on the receiver driven by the driving means.

8. The apparatus of claim 5 wherein said platen drag applying means further comprises an electrical generator and a load, the generator coupled to the platen drum so as to generate electricity into the load upon rotation of the platen drum due to movement of the receiver through the print station by said driving means in the first, print direction.

9. In a thermal transfer color printer, a method for avoiding misregistrations between successive color separation images on a sheet or web receiver upon which registered images are printed, comprising the steps of:

driving the receiver in a first, print direction through a print station comprising a thermal print head, having a plurality of heating elements, and a platen drum mounted for forward rotation during presentation of the receiver to the thermal print head in a first, print direction of conveyance pursuant to successive printing of different, overlying color separation images on the receiver;

advancing a dye carrier between the receiver and the print head heating elements to cause dye to transfer from the carrier to an image pixel in the receiver by operation of the thermal print head heating elements; and applying a drag to the rotation of said platen drum in opposition to the the forward rotation to apply back tension on the receiver greater than force disturbances created by slipping and sticking phenomena occurring at the heating elements of the thermal print head.

10. The method of claim 9 wherein said applying step further comprises a step of applying a rotational driving torque to said platen drum in opposition to the first, print direction to cause the platen drum to slip backwards against the rotational driving torque.

11. The method of claim 9 wherein said applying step further comprises attaching a drag brake to a freely rotating axle of the platen drum to inhibit free rotation of the platen drum and impose a drag on the receiver when driven in the first, print direction.

12. The method of claim 9 wherein said applying step further comprises attaching an electrical generator and a load to a freely rotating axle of the platen drum so as to generate electricity into the load upon rotation of the platen roller due to movement of receiver through the print station in the first, print direction.

13. The method of claim 9 wherein said driving step further comprises employing a capstan and pinch roller to bear against opposite surfaces of the receiver and rotating the capstan to drive the receiver in the first, print direction.

14. Apparatus for printing images on a receiver comprising:

a rotatable platen drum;

a print head adapted to print images on the receiver when the receiver is moved between the print head and the platen drum;

driving means for moving the receiver in a print direction between the print head and the platen drum;

means for applying drag to the platen drum during movement of the receiver past the print head by the driving means and for thereby imparting back tension to the receiver through frictional engagement of the receiver by the platen drum.

15. The apparatus of claim 14 wherein said platen drum drag applying means further comprises means for applying a rotational driving torque to said platen drum in opposition to the print direction and at a lower relative force to allow the driving means to override the rotational driving torque and to cause the platen drum to slip backwards.

16. The apparatus of claim 14 wherein said platen drum drag applying means further comprises a drag brake attached to an axle of the platen drum to inhibit free rotation of the platen drum and impose a drag on the receiver driven by the driving means.

17. The apparatus of claim 14 wherein said platen drag applying means further comprises an electrical generator and a load, the generator coupled to the platen drum so as to generate electricity into the load upon rotation of the platen drum due to movement of the receiver through the print station by said driving means in the print direction.

18. The apparatus of claim 14 wherein said platen drag applying means further comprises an electrical eddy-current brake attached to the rotatable platen drum.

* * * * *